United States Patent [19]

Warshawsky

[11] 4,390,933

[45] Jun. 28, 1983

[54] MULTIPLE POSITION LAMP

[75] Inventor: Jerome Warshawsky, Baldwin, N.Y.

[73] Assignee: I. W. Industries, Inc., Melville, N.Y.

[21] Appl. No.: 215,507

[22] Filed: Dec. 11, 1980

[51] Int. Cl.[3] ..... F21V 21/22; F21V 21/26; F21S 1/12; F21S 3/12

[52] U.S. Cl. ..... 362/270; 362/285; 362/413; 362/414; 362/418; 362/419; 362/427; 362/431; 362/449; 362/450

[58] Field of Search ..... 362/414, 413, 418, 419, 362/431, 450, 270, 285, 427, 449

[56] References Cited

U.S. PATENT DOCUMENTS

| | | | |
|---|---|---|---|
| 1,919,114 | 7/1933 | Ley | 362/413 |
| 2,409,075 | 8/1946 | Starch | 362/413 |
| 2,490,125 | 12/1949 | Greppin | 362/413 |
| 2,642,246 | 6/1953 | Stephans | 362/413 |
| 2,712,056 | 6/1955 | Murray | 362/413 |
| 2,902,592 | 9/1959 | Cole et al. | 362/413 |
| 3,012,801 | 12/1961 | Cole | 362/413 |
| 3,462,594 | 8/1969 | Brown | 362/413 |

*Primary Examiner*—Irwin Gluck

*Attorney, Agent, or Firm*—Stephen E. Feldman; Marvin Feldman; Jules L. Chaboty

[57] ABSTRACT

A lamp is provided of tubular member design with cooperative friction and sliding elements which readily interfit into the tubular members so as to be fully positional in the upward travel, as well as rotatable through substantially 360°. The construction is of simplified design so as to make manufacture and assembly readily achievable.

6 Claims, 3 Drawing Figures

FIG. 1
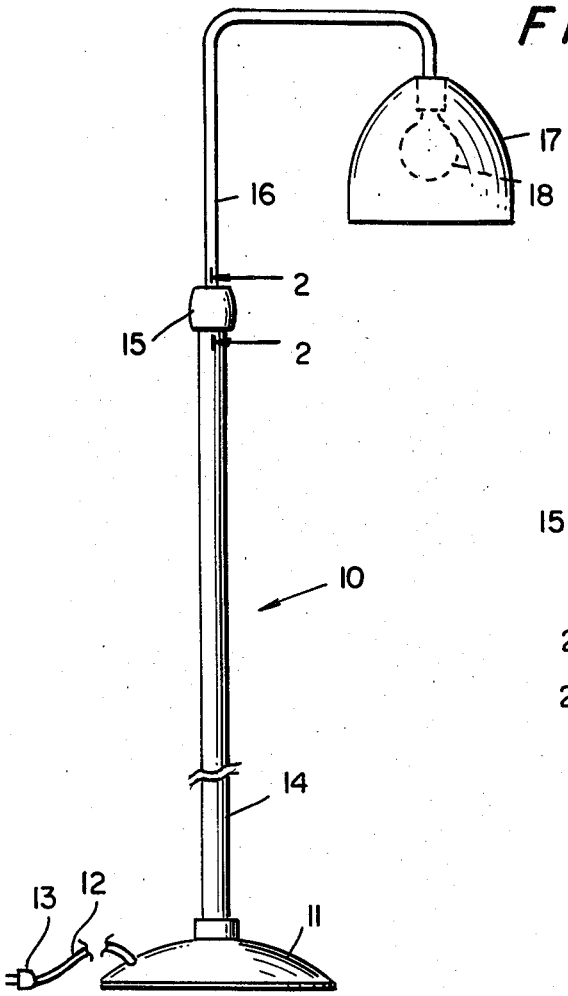
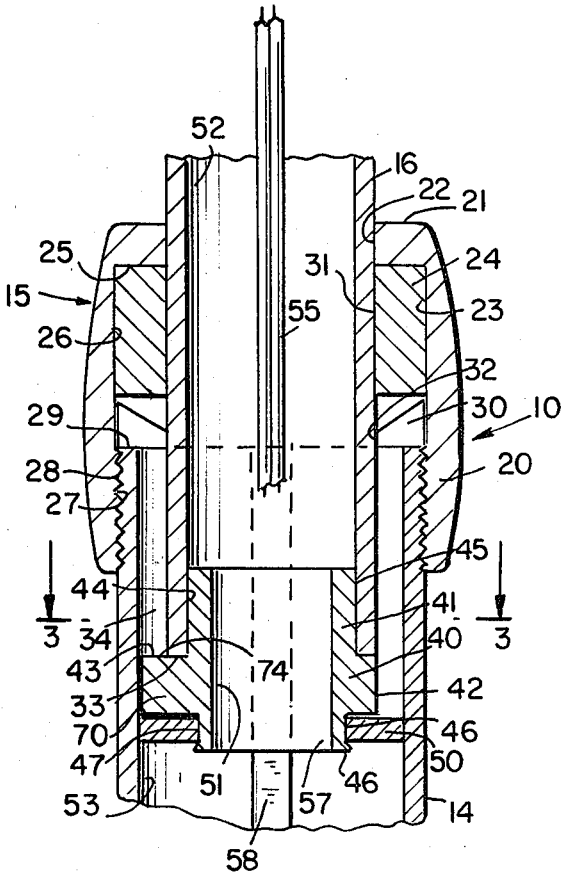
FIG. 2
FIG. 3
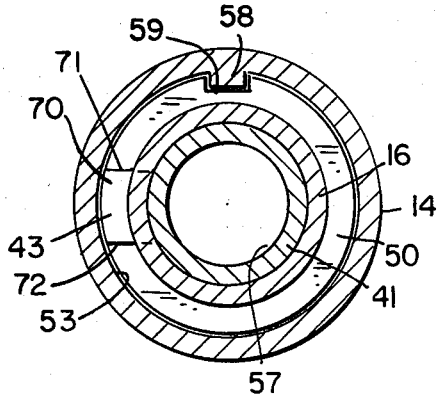

MULTIPLE POSITION LAMP

FIELD OF THE INVENTION

This invention relates to a lamp and more specifically to a multiple position lamp.

BACKGROUND AND DISCUSSION OF PRIOR ART

The orientation of a light source is important to a person requiring light at various positions, yet utilizing only a single light source. Therefore, in a general sense, floor lamps have suffered from the disadvantages of providing only limited degrees of orientation while otherwise being of complex design and manufacture.

Prior art attempts to resolve this problem were as disclosed in U.S. Pat. No. 4,034,214 to Chapman et al I; J. A. Dickey, U.S. Pat. No. 1,889,978; Chapman, Jr. et al II, U.S. Pat. No. 3,694,647; R. Cole, U.S. Pat. No. 3,012,801; Chapman et al, U.S. Pat. No. 3,955,079 III; and J. Warshawsky, U.S. Pat. No. 3,185,838.

Chapman et al I, is a tubular member design, but requires a construction wherein projecting pins must be located in machined holes, which not only required drilling and fitting operations, but the pins were subject to breakage or damage in extended use.

While such attempts proved only modestly sucessful the industry desired a fully positional lamp, with a high degree of movement both in the vertical, as well as rotational direction and yet, of clean, simplified design and manufacture with good wear performance.

Now there is provided by the present invention a lamp, which permits a high degree of vertical and rotational travel and achieves this with cooperative frictional and sliding elements which elements are readily manufactured and assembled to tubular lamp support members.

IN THE DRAWINGS

FIG. 1 is an elevational view of the lamp of the present invention;

FIG. 2 is an enlarged fragmentary sectional view taken along line 2—2 of FIG. 1; and FIG. 3 is a transverse sectional view taken along line 3—3 of FIG. 2.

SUMMARY OF THE INVENTION

In one aspect the present invention comprises an improved multiple position lamp wherein tubular members are telescopically and rotatably movable by cooperative action of interfitted elements which readily connect to one member and vertically slide and rotatably abut the interior spline of another member, with such elements being of simplified manufacture. The elements are readily formed from tubular or annular stock pieces and interfit to provide positive lamp movement, and yet withstand extended use.

DESCRIPTION OF THE PREFERRED EMBODIMENTS

Referring to FIG. 1, there is shown a floor lamp 10 generally comprising a base 11, power cord and outlet 12 and 13, respectively, a vertical support tubular member or post 14, collar assembly 15, angled adjustable tubular member or post 16, lamp shade or lamp mounting means 17 and lamp 18.

Referring to FIGS. 2 and 3, specifically, there is shown collar assembly 15 in more detail. Assembly 15 comprises collar 20 which is formed with top wall 21 having an axial bore 22 for slidably receiving post 16, during vertical travel of post 16. Collar 20 is formed with an internal recess 23 for receiving annular sleeve 24 which abuts internal walls 25 and 26. Collar 20 is also formed with internal threaded portion 27 for interengaging external threaded portion 28 of post 14. Post 14 is formed with annular edge 29 which is coterminus with the end of the engaged threaded portons 27 and 28. A bevelled post retaining and stop ring 31 is lodged between sleeve 24 and post edge 29. Sleeve 24 is formed with bore 31 and ring 30 is formed with bore 32, so that post 16 slides within these bores.

Post 16 is formed at its lower portion 34 with the bottom edge 33. A piece of tubing may be rough cut to form block 40 which is formed with an internal tubular section 41 and bore 42 integrally formed therewith. Edge 33 rests against top face 43 of bore 42, and inner circumferential wall 44 engages outer wall 45 of tubular section 41. Base 42 is joined with a lower depending annular flange 46 and formed with a recess or groove 47. A retaining ring 50 is clipped or peened into groove 47, for purposes hereinafter appearing.

Block 40 is formed with an axial bore 51, which along with the axial bores 52 and 53 of posts 16 and 14 respectively, form a through hole for electrical lamp wires 55 which interconnect lamp 18 to power cord 12.

Block 40 is formed with an outwardly projecting flange 70 which has flat vertical surfaces 71 and 72 for abutting spline 58 in rotation of the block 40, which rotates in concert with post 16. In this manner of construction, post 16 and block 40 rotate, and ring 50 is locked in place by spline 58 and groove 59. Ring 50 is formed with a shaped groove 59 for slidably engaging spline 58 during vertical travel of Post 16.

One novel aspect of the present invention is that post 14 is integrally formed with a vertical internal spline 58 which extends the entire length of post 14, and the elements 70 and 50 connected to post 16 cooperate with spline 58, to provide both the rotatable and slidable movements of post 16 in post 14.

In the vertical upward travel, the top surface 74 of flange 70 abuts ring 30 to limit the upward travel of post 16 within post 14.

The collar assembly 15 cooperates with the rotatable and vertical movements to selectively fix the lamp in position, once the lamp is at its desired position, as will be further discussed. When it is desired to adjust the lamp position, collar assembly 15 is slightly unscrewed and post 16 is then moved vertically and rotatably to the desired position. Once at the desired position, the collar assembly 15 is screwed tight so that ring 30 is pressed downwardly and inwardly by block 24 so as to frictionally hold post 16 in place.

I claim:

1. A multiple position lamp comprising;

a base;

a telescopic body mounted to said base, said body including first and second tubular members, said first member being fixed to said base and being formed with a longitudinal rib on an interior surface thereof, said second tubular member being telescopically received within said first tubular member and being rotatably movable to said first tubular member, a ring being disposed within said first tubular member and being formed of a groove for slidably receiving said rib for vertical movement; and a block member, and means to connect said block member to said second tubular member and means to connect said block member to said ring, said block member being formed with a radial flange for abutting said rib in rotation of said second tubular member in said first tubular member so as to limit rotational movement of said second tubular member relative to said first tubular member to less than 360°; said ring being of annular configuration and having an outer circumference slidably disposed with said first tubular member and an inner circumference slidably disposed with said block member;

a receptacle adapted to receive a lamp; and means for mounting said receptacle to said second tubular member for movement therewith; further comprising a collar, said collar being disposed around said tubular members and being formed with means to releasably interconnect said tubular members; whereby on releasing said tubular members said second member vertically slides with said block member on the rib of said first member and rotates within the block member until said flange abuts said rib; said rib having parallel sides, and said flange being formed with a circumferential outer surface for slidably engaging the inside of said first member and parallel side surfaces for abutting said rib.

2. The lamp of claim 1, said block member comprising a groove formed at its lower end, below said ring with said flange being disposed above said ring.

3. The lamp of claim 2, said block member being formed so as to fit with said second tubular member.

4. The lamp of claim 1, said collar comprising a threaded portion, and said first tubular member comprising a threaded portion for engaging said collar threaded portion, and means to fixedly hold said second tubular member when said threaded portions are tightly engaged.

5. The lamp of claim 1, said block member being formed with a bore, which is coaxially disposed with said tubular members.

6. The lamp of claim 5, said lamp comprising an electric cord being disposed within said bore.

* * * * *